US010463085B2

(12) United States Patent
McGargill

(10) Patent No.: US 10,463,085 B2
(45) Date of Patent: Nov. 5, 2019

(54) ATHLETIC GARMENT WITH WEATHER BARRIER INSERT

(71) Applicant: Tim McGargill, Omaha, NE (US)

(72) Inventor: Tim McGargill, Omaha, NE (US)

( * ) Notice: Subject to any disclaimer, the term of this patent is extended or adjusted under 35 U.S.C. 154(b) by 157 days.

(21) Appl. No.: 15/702,140

(22) Filed: Sep. 12, 2017

(65) Prior Publication Data

US 2018/0070654 A1 Mar. 15, 2018

Related U.S. Application Data

(60) Provisional application No. 62/393,398, filed on Sep. 12, 2016.

(51) Int. Cl.

| | |
|---|---|
| ***A41D 1/084*** | (2018.01) |
| ***A41D 1/082*** | (2018.01) |
| ***A41D 27/02*** | (2006.01) |
| ***A41D 27/20*** | (2006.01) |
| ***A41F 9/02*** | (2006.01) |

(52) U.S. Cl.

CPC ..... *A41D 1/084* (2013.01); *A41D 1/082* (2013.01); *A41D 27/02* (2013.01); *A41D 27/201* (2013.01); *A41D 27/205* (2013.01); *A41D 27/208* (2013.01); *A41F 9/025* (2013.01); *A41D 2300/32* (2013.01); *A41D 2300/322* (2013.01); *A41D 2300/324* (2013.01); *A41D 2600/104* (2013.01)

(58) Field of Classification Search

CPC .. A41B 9/14; A41B 9/04; A41B 11/14; A41D 1/06; A41D 1/084

USPC ..... 2/228, 69, 238

See application file for complete search history.

(56) References Cited

U.S. PATENT DOCUMENTS

| | | | | |
|---|---|---|---|---|
| 2,034,312 A * | 3/1936 | Rubin | ..... | A41D 1/06 2/228 |
| 2,599,769 A * | 6/1952 | MacRae | ..... | A41D 1/08 2/228 |
| 4,671,973 A | 6/1987 | Hults et al. | | |

(Continued)

FOREIGN PATENT DOCUMENTS

| | | |
|---|---|---|
| EP | 2599397 | 6/2013 |

OTHER PUBLICATIONS

International Search Report & Written Opinion dated Dec. 14, 2017.

*Primary Examiner* — Gloria M Hale

(74) *Attorney, Agent, or Firm* — Ryan T. Grace; Advent, LLP

(57) ABSTRACT

An athletic garment can protect a user from inclement weather conditions (e.g. wind, moisture, cold, etc.). The athletic garment includes an outer layer forming an article of wearing apparel (e.g., shorts, pants, tights, etc.). The outer layer includes one or more garment forming portions coupled to a waistband and configured to receive the legs of a user. An inner liner is coupled to the waistband. The inner liner includes a front panel and a rear panel, the front panel and the rear panel being joined and configured to receive the legs of the user. The inner liner includes an elongated pocket configured to receive an insert through an opening disposed therein. A weather-resistant insert is configured to removably couple to the pocket, substantially the entirety of the weather-resistant insert being comprised of a pliable textile material, the insert being generally formed to movement of the user.

20 Claims, 5 Drawing Sheets

(56) References Cited

U.S. PATENT DOCUMENTS 4,894,867 A * 1/1990 Ceravolo ..... A41D 1/08 2/227
4,945,571 A * 8/1990 Calvert ..... A41D 1/084 2/161.1
4,961,233 A * 10/1990 Black ..... A41D 1/084 2/228
5,052,058 A * 10/1991 Mueller ..... A41B 9/001 2/228
5,103,505 A * 4/1992 Llorens ..... A41D 13/0537 2/228
5,136,727 A * 8/1992 Brisco ..... A41D 1/08 2/228
5,271,101 A * 12/1993 Speth ..... A41D 1/084 2/214
5,539,927 A * 7/1996 Holubec ..... A41D 1/08 2/227
5,598,586 A * 2/1997 Munjone ..... A41D 1/08 2/228
5,836,015 A * 11/1998 Kristensen ..... A41D 13/0158 2/23
5,956,774 A * 9/1999 Mackley ..... A41D 1/089 2/227
6,115,847 A * 9/2000 Rosch ..... A61F 13/496 2/228
6,161,222 A * 12/2000 Strickland ..... A41D 1/089 2/228
6,182,297 B1 * 2/2001 Duren ..... A41B 9/001 2/228
6,192,521 B1 * 2/2001 Alberts ..... A41D 7/00 156/73.1
6,464,717 B1 10/2002 Smith et al.
6,665,882 B1 * 12/2003 Pedrick ..... A41D 7/005 2/228
8,528,114 B2 * 9/2013 Baiany ..... A41D 27/02 2/228
2003/0051288 A1 3/2003 Dugan
2011/0209267 A1 * 9/2011 Rush ..... A41D 1/08 2/228
2012/0227164 A1 9/2012 Komoriya
2016/0073705 A1 * 3/2016 DeLaRosa ..... A41D 13/0506 2/228
2016/0120248 A1 * 5/2016 Oliver ..... A41B 9/00 2/69

* cited by examiner

ATHLETIC GARMENT WITH WEATHER BARRIER INSERT

CROSS-REFERENCE TO RELATED APPLICATIONS

The present application claims the benefit under 35 U.S.C. § 119(e) of U.S. Provisional Application Ser. No. 62/393,398, filed Sep. 12, 2016, and titled "ATHLETIC GARMENT WITH WEATHER BARRIER INSERT," which is herein incorporated by reference in its entirety.

BACKGROUND

Athletic shorts (e.g., gym shorts, running shorts, etc.) are an article of clothing commonly worn by people when exercising or playing sports. Athletic shorts are constructed in ways that maximize comfort and ease of movement.

SUMMARY

An athletic garment is described for protecting a user from inclement weather conditions (e.g. wind, moisture, cold, etc.). The athletic garment includes an outer layer forming an article of wearing apparel (e.g., shorts, pants, tights, etc.). The outer layer includes one or more garment forming portions coupled to a waistband and configured to receive the legs of a user. An inner liner is coupled to the outer layer. The inner liner includes a front panel and a rear panel, the front panel and the rear panel being joined and configured to receive the legs of the user. The inner liner includes an elongated pocket configured to receive an insert through an opening disposed therein. A weather-resistant insert is configured to removably couple to the pocket, substantially the entirety of the weather-resistant insert being formed of a pliable textile material, the insert being generally conformable to movement of the user.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Figure 1:
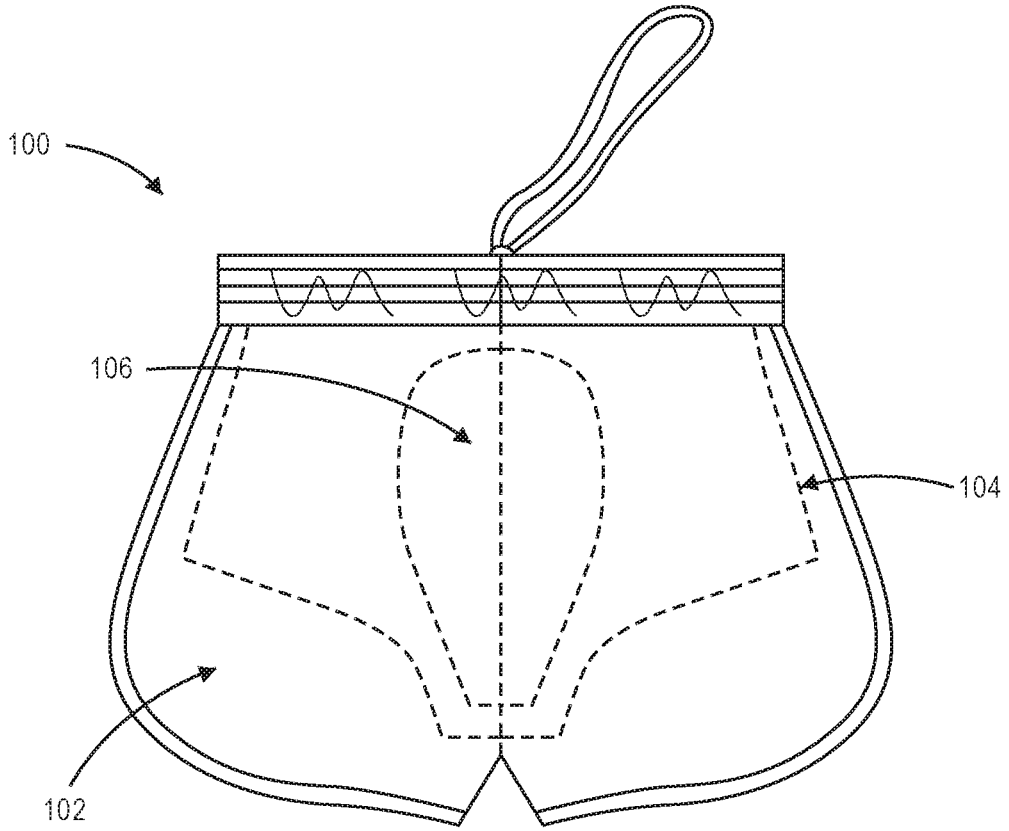
FIG. 1 is a front view illustrating an athletic garment in accordance with an example embodiment of the present disclosure.

Athletic garments (e.g., short, skirts pants, etc.) are worn for exercising, sports (e.g., running, jogging, hiking, skiing, biking, etc.), or other athletic activities. Because athletic activities can occur both indoors and outdoors, it is desirable for athletic garments to be constructed to be both weather-resistant and comfortable in a variety of weather conditions.

An athletic garment is described for protecting a user from inclement weather conditions (e.g. wind, moisture, cold, etc.). The athletic garment includes an outer layer forming an article of wearing apparel (e.g., shorts, pants, tights, etc.). The outer layer includes one or more garment forming portions coupled to a waistband and configured to receive the legs of a user. An inner liner is coupled to the outer layer. The inner liner includes a front panel and a rear panel, the front panel and the rear panel being joined and configured to receive the legs of the user. The inner liner includes an elongated pocket configured to receive an insert through an opening disposed therein. A weather-resistant insert is configured to removably couple to the pocket, substantially the entirety of the weather-resistant insert being formed of a pliable textile material, the insert being generally conformable to movement of the user.

Example Implementations

Referring generally to FIGS. 1 through 5, an athletic garment 100 is described. The athletic garment 100 includes an outer layer 102 configured to form an article of wearing apparel (e.g., shorts, pants, etc.). The outer layer 102 is coupled with an inner liner 104. The inner liner 104 includes a weather-resistant insert 106.

Figure 2A:
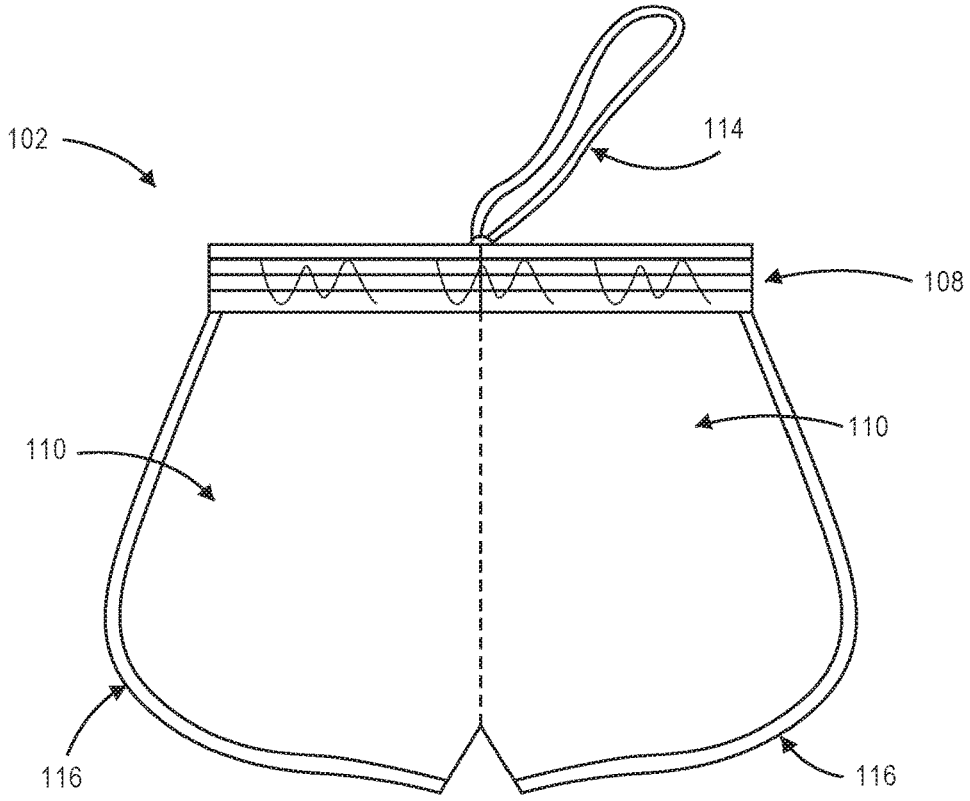
FIG. 2A is a front view illustrating an outer layer of an athletic garment, such as the athletic garment illustrated in FIG. 1, in accordance with an example embodiment of the present disclosure.
Figure 2B:
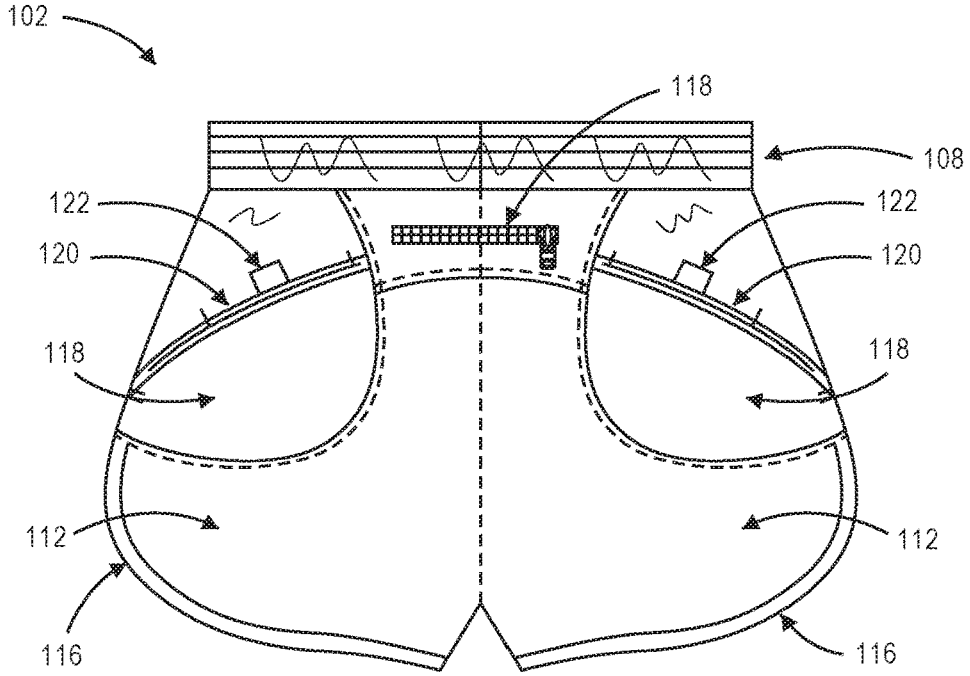
FIG. 2B is a back view illustrating an outer layer of an athletic garment, such as the athletic garment illustrated in FIG. 1, in accordance with an example embodiment of the present disclosure.
Figure 3A:
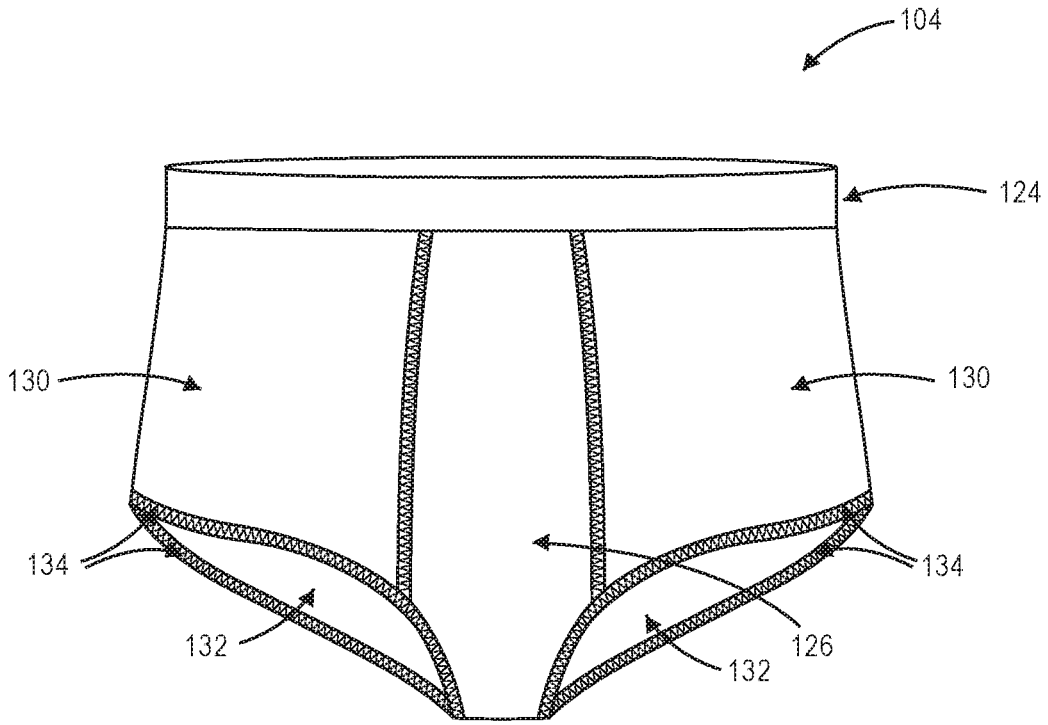
FIG. 3A is a front view illustrating an inner liner of an athletic garment, such as the athletic garment illustrated in FIG. 1, in accordance with an example embodiment of the present disclosure.
Figure 3B:
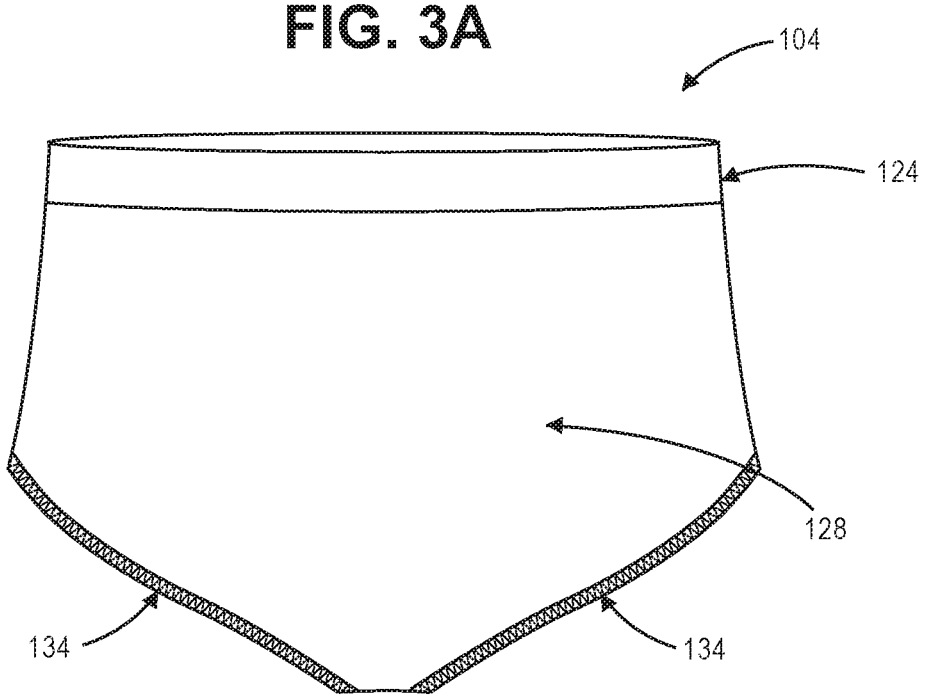
FIG. 3B is a back view illustrating an inner liner of an athletic garment, such as the athletic garment illustrated in FIG. 1, in accordance with an example embodiment of the present disclosure.

The outer layer 102 is best illustrated FIGS. 2A and 2B. In implementations, the outer layer 102 of the athletic garment 100 can include, a waistband 108 defining a waist opening configured to receive a user's waist, and a plurality of garment forming portions such as one or more front panels 110, one or more rear panels 112, and/or one or more side panels (not pictured). Alternatively, the outer layer 102 may be made of a one-piece (e.g., monolithic) structure. In such embodiments, the outer layer 102 may be, for example, knitted together in a unitary (e.g., indivisible) manner to form a front portion, a rear portion, and side portions. The waistband 108 may be wholly or partially made of any suitable elastic material configured to secure the athletic garment 100 against the user's waist. In some implementations, the waistband 108 can comprise elastic drawcord 114 and/or a drawstring for tightening the athletic garment 100 against the user's waist (as described with reference to FIG. 2A). The waistband 108 is attached to and extends along an upper portion of the front panels 110, the rear panels 112, and/or the side panels.

In implementations, the outer layer 102 can comprise athletic shorts. For example, the front panels 110 and the rear panels 112 can interconnect to form leg openings 116 (as described with reference to FIGS. 2A and 2B). Alternatively, the side panels can interconnect with the front panel 110 and rear panel 112, collectively forming leg openings 116. Each leg opening 116 is configured to receive a user's legs. The panels can be joined by one or more vertical seams and/or one or more horizontal seams. The waist opening defined by the waistband 108 is configured to allow a user to put on the athletic garment 100 by placing his legs through the leg openings 116. While an outer layer 102 comprising athletic shorts is illustrated in FIGS. 1 through 2B, it is contemplated that the outer layer can comprise other athletic garments (e.g., pants, tights, etc.).

The outer layer 102 can comprise any suitable material (e.g., fabric) which forms an apparel article. Suitable materials can include, but are not necessarily limited to: cotton, polyester, bamboo, polypropylene, spandex, wool, nylon, lyocell (e.g., TENCEL®), elastane (e.g., LYCRA®), mesh, combinations thereof, and so forth. The inseam of the outer layer 102 can be constructed in a variety of lengths. In exemplary embodiments, the outer layer can 102 have a three (3) inch inseam, a five (5) inch inseam, or a seven (7) inch inseam. The length and/or the material of the outer layer 102 can be selected based on a variety of factors including the athletic activity the athletic garment 100 is to be utilized for, user preferences, and so forth.

The outer layer 102 can further include one or more pockets 118, as illustrated in FIG. 1B. The pockets 118 can be configured in a variety of shapes and sizes. In some implementations, the pockets 118 can include one or more fasteners for closing the pockets 118. The fasteners can comprise zippers, buttons, snaps, hooks, a fastener material (e.g., Velcro®), and so forth, or any combination thereof. In some implementations, the pockets 118 can include elastic 120 (e.g., elastic casing and/or elastic binding) lining the pocket 118 opening (e.g., along the upper hem). The elastic 120 can help the pocket conform to the anatomy of the user and can securely hold items placed within the pockets. In some embodiments, the pockets 118 can be configured to hold bulky items (e.g., keys, mobile electronic devices, etc.). For example, the pocket can include pleat(s), gather(s), tuck(s), and/or gusset(s) to allow for expansion. In exemplary implementations, the outer layer 102 can include two opposing pockets 118 located on the rear panels 112 and one pocket located at approximately the midpoint of the rear panels 112 (as described with reference to FIG. 2B). However, this configuration of pockets 118 is offered by way of example only and is not meant to be restrictive of the present disclosure. In other embodiments, the outer layer 102 may include any number of pockets 118 in any location. In some embodiments, the pockets 118 can include one or more tabs 122 to facilitate opening of the pockets (e.g., as described with reference to FIG. 2B). The attachment seams between the pockets and the outer layer 102 may follow a straight, angled, and/or curved path to form a pocket with a desired shape, depth, appearance, etc. In implementations, one or more of the pockets 118 can include a water-resistant and/or waterproof lining formed from a material such as polyurethane laminate (PUL), fabric laminate, vinyl, oil cloth, polytetrafluoroethylene (e.g., GORE-TEX®), and so forth. The water-resistant and/or waterproof lining can protect items (e.g., keys, mobile electronic devices, etc.) placed within the pockets 118 and/or act as a barrier for the user against wet and/or sticky items placed within the pockets 118.

Referring now to FIGS. 3A through 4B, the outer layer 102 is coupled to the inner liner 104. The inner liner 104 can include a waistband 124 defining a waist opening configured to receive a user's waist and a plurality of garment forming portions such as one or more front panels 126, one or more rear panes 128, and/or one or more side panels 130. The inner liner 104 can be joined (e.g., knitted) to the outer layer 102 at the waistbands 108, 124. Alternatively, an upper portion of the front panel 126, rear panel 128, and/or side panels 130 can be joined directly to the waistband 108 of the outer layer 102 (e.g., as described with reference to FIG. 1).

In implementations, the inner liner 104 can comprise a short or brief (e.g., as described with reference to FIGS. 3A through 4B). For example, the side panels 130 can interconnect with the front panel 126 and rear panel 128, collectively forming leg openings 132. Each leg opening 132 is configured to receive a user's leg. In some implementations, the leg openings 132 can include elastic 134 (e.g., elastic casing and/or elastic binding) to securely fit the user's legs. In implementations, the panels can be joined by one or more vertical seams and/or one or more horizontal seams. In exemplary implementations, the inner liner 104 comprises a generally anatomically shaped short/brief. However, a brief-shaped inner liner 104 is offered by way of example only and is not meant to be restrictive of the present disclosure. It is contemplated that the inner line can comprise other shapes (e.g., pants). The shape of the inner liner 104 can be selected based on the type of outer layer (e.g., shorts, pants, tights, etc.), user preferences, and so forth.

The inner liner 104 can comprise any suitable material (e.g., fabric) which reduces moisture, reduces chafing, and/or enhances breathability of the athletic garment 100. Suitable materials can include, but are not necessarily limited to: cotton, polyester, bamboo, polypropylene, lyocell (e.g., TENCEL®), mesh, combinations thereof, and so forth. In exemplary implementations, the inner liner 104 comprises honeycomb knit mesh.

Figure 4A:
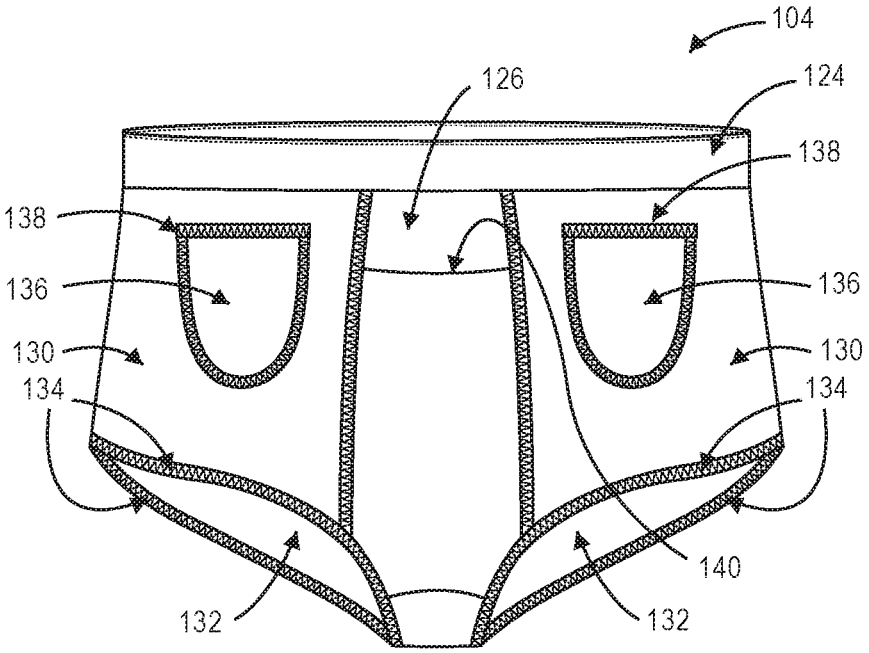
FIG. 4A is a front view illustrating an interior surface of an inner liner, such as the inner liner illustrated in FIG. 3A, in accordance with an example embodiment of the present disclosure.
Figure 4B:
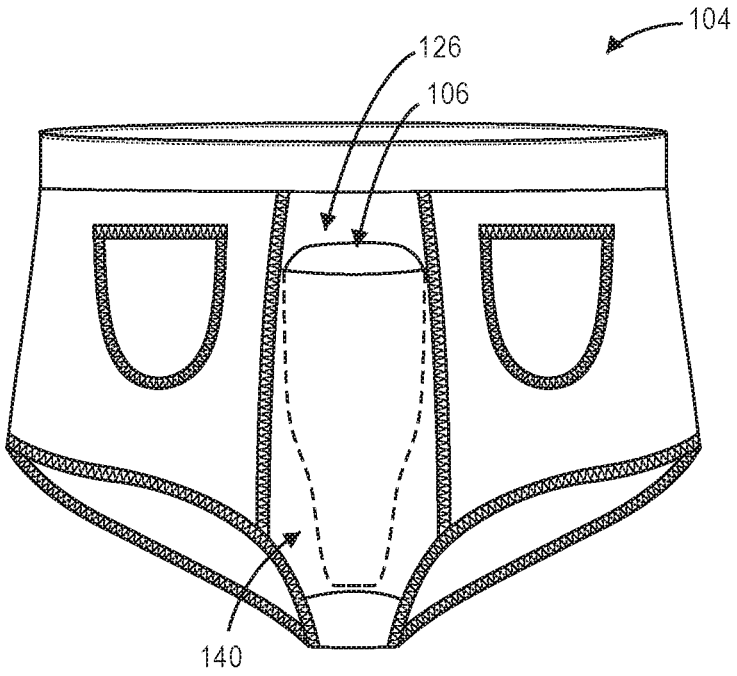
FIG. 4B is a front view illustrating an interior surface of an inner liner, such as the inner liner illustrated in FIG. 3A, including a removable insert, in accordance with an example embodiment of the present disclosure.

The inner liner 104 can further include one or more pockets 136. In implementations, the pockets 136 can be located on an interior surface of the inner liner 104, as illustrated in FIGS. 4A and 4B. The pockets 136 can be configured in a variety of shapes and sizes. In some implementations, the pockets 136 can include elastic 138 (e.g., elastic casing and/or elastic binding) lining the pocket 136 openings (e.g., along the upper hem). The elastic 138 can help the pocket conform to the anatomy of the user and can securely hold items placed within the pockets. In some embodiments, the pockets 136 can be configured to hold bulky items (e.g., keys, mobile electronic devices, etc.). For example, the pocket can include pleat(s), gather(s), tuck(s), and/or gusset(s) to allow for expansion. In some implementations, the pockets 136 can include one or more fasteners for closing the pockets. The fasteners can comprise zippers, buttons, snaps, hooks, a fastener material (e.g., Velcro®), and so forth, or any combination thereof. In exemplary implementations, the inner liner 104 can include two opposing pockets located on an interior surface of the side panels 130 (as described with reference to FIG. 4). However, this configuration of pockets 136 is offered by way of example only and is not meant to be restrictive of the present disclosure. In other embodiments, the inner liner 104 can include any number of pockets in any location. In some embodiments, the pockets 136 can include one or more tabs to facilitate opening of the pockets. The attachment seams between the pockets and the inner liner 104 may follow a straight, angled, and/or curved path to form a pocket with a desired shape, depth, appearance, etc. In implementations, one or more of the pockets 136 can include a water-resistant and/or waterproof lining formed from a material such as polyurethane laminate (PUL), fabric laminate, vinyl, oil cloth, polytetrafluoroethylene (e.g., GORE-TEX®), and so forth. The water-resistant and/or waterproof lining can protect items (e.g., keys, mobile electronic devices, etc.) placed within the pockets 136 and/or act as a barrier for the user against wet and/or sticky items placed within the pockets 136.

The inner liner 104 can further include an insert pocket 140 configured for receiving a removable insert 106, as illustrated in FIGS. 4A and 4B. In some embodiments, the insert pocket 140 can be disposed on the front panel 126 of the inner liner 104. For example, the insert pocket 140 can be located on an interior surface of the front panel 126. In some implementations, the insert pocket 140 can include elastic (e.g., elastic casing and/or elastic binding) lining the insert pocket 140 opening (e.g., along the upper hem) to securely hold the insert 106 within the insert pocket 140. In implementations, the insert pocket 140 is configured to generally conform to the shape of the front panel 126. For example, the insert pocket 140 can comprise an elongated shape.

Figure 5:
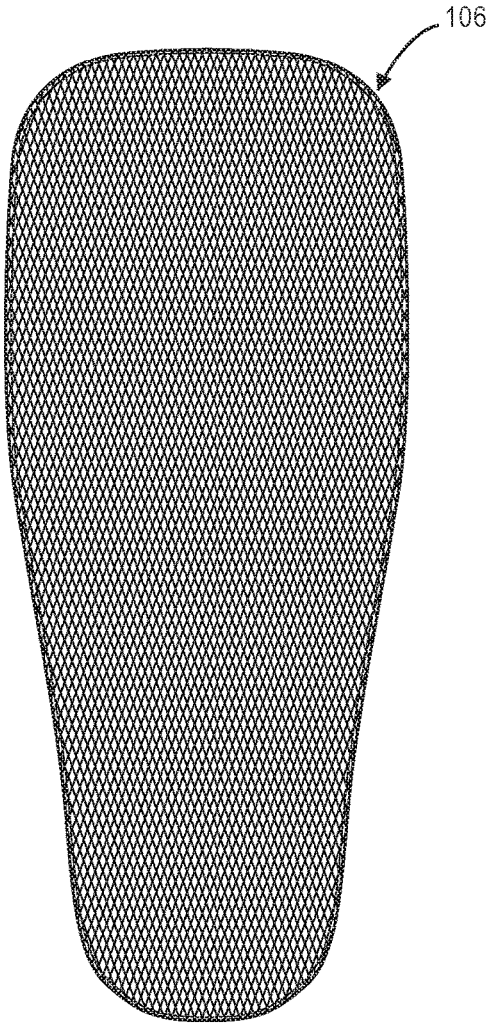
FIG. 5 is a front view illustrating a removable insert of an athletic garment, such as the athletic garment illustrated in FIG. 1, in accordance with an example embodiment of the present disclosure.
Figure 6:
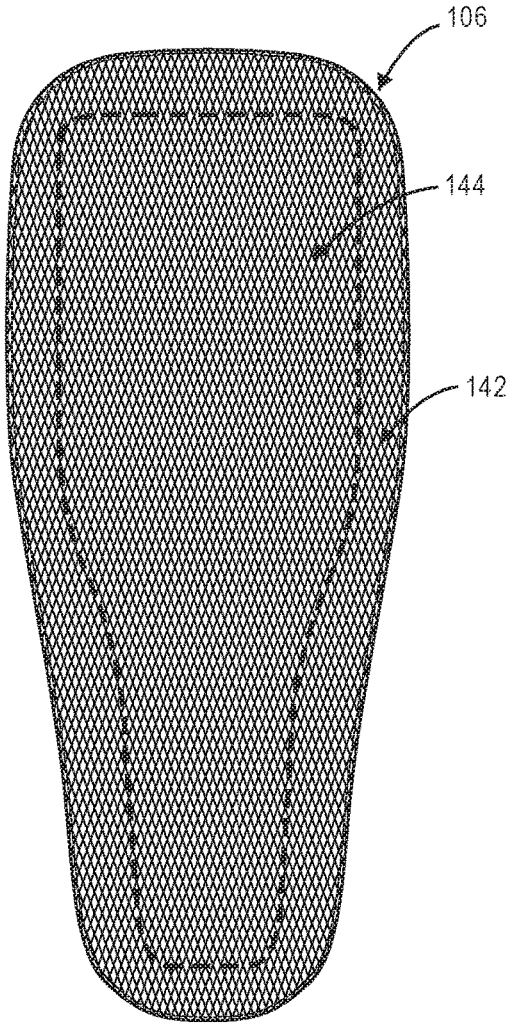
FIG. 6 is a front view illustrating a removable insert of an athletic garment, such as the athletic garment illustrated in FIG. 1, the insert including an outer layer and an inner layer in accordance with an example embodiment of the present disclosure.

The insert 106 is best illustrated in FIGS. 5 and 6. The insert 106 can comprise a weather-resistant (e.g., cold, moisture, and/or wind resistant) barrier configured to protect the user in inclement weather conditions. For example, the insert 106 can comprise a wind barrier to protect the user's genitalia in windy and/or cold conditions. In some aspects, the insert 106 may be pliable (e.g., easily bent or shaped) or otherwise generally conformable to movements of the user, e.g., to maximize comfort and/or to facilitate a full range of motion of the user during a workout. The insert 106 can be formed, at least partially, from a wind, cold, and/or moisture resistant material including, but not necessarily limited to: polytetrafluoroethylene (e.g., GORE-TEX®), fleece, cotton, polyester, fabric laminate (e.g., WINDSTOPPER®, THINTECH®, etc.), wool, nylon (e.g., hydrophilic nylon), multi-zone lining materials (e.g., DRI-LEX®), combinations thereof, and so forth. In some aspects, the insert 106 may include one or more types of fibrous material, such as one or more those listed immediately above, and in some aspects, the fibrous material may be in the form of a textile material (e.g., cloth or fabric). In some manifestations, the insert 106 can be formed from a pliable material. For example, the insert 106 may be made of a material with a 1/Young's Modulus (e.g., 1/Modulus of Elasticity) in a range of $9\times10^{-2}$ 1/MPa to $2\times10^{0}$ 1/MPa (e.g., a range for various types of cloth). By comparison, many common plastics have a 1/Young's Modulus in a range of $4\text{-}9\times10^{-3}$ 1/MPa. In specific embodiments, substantially the entirety of the insert 106 is formed from the pliable material. In these embodiments, substantially the entirety of the insert 106 is generally conformable to movements of the user.

In some implementations, the insert 106 can further include an outer layer 142 formed from a material selected to enhance comfort and/or breathability. Suitable materials can include, but are not necessarily limited to: cotton, polyester, bamboo, polypropylene, lyocell (e.g., TENCEL®), mesh, nylon (e.g., hydrophilic nylon), multi-zone lining materials (e.g., DRI-LEX®), combinations thereof, and so forth. In some embodiments, the insert 106 includes a plurality of layers configured as a moisture barrier (e.g., as described with reference to FIG. 6). For example, the insert 106 can include an outer layer 142 and an inner layer 144. The layers 142, 144 can draw moisture away from the skin of the user. In specific manifestations, the insert 106 is formed, at least partially, from a multi-layered material and/or a multi-zone lining material (e.g., DRI-LEX®). The multi-zone lining material can include a hydrophobic polyester outer layer 142 and one or more hydrophilic nylon inner layers 144. Moisture can diffuse from the surface of the hydrophobic outer layer 142 to the hydrophilic inner layers 144, drawing moisture away from the skin. Although FIG. 6 shows the inner layer 144 as being smaller than the outer layer 142 (e.g., occupying a smaller surface area), it is to be understood that the inner layer 144 and the outer layer 142 may be the same size, for example, in embodiments where the outer layer 142 and the inner layer 144 are formed as a multi-zone and/or multi-layered material.

In implementations, the insert 106 can comprise a generally oblong shape configured to fit within the insert pocket 140 and cover the user's genitalia. An end portion of the insert 106 may be tapered so as to conform to a generally anatomical shape. An interior surface of the insert 106 can include one or more fasteners configured to hold the insert 106 in place within the insert pocket 140. The fasteners can comprise buttons, snaps, hooks, a fastener material (e.g., Velcro®), and so forth, or any combination thereof. For example, a back surface of the insert 106 can include fasteners configured to mate with corresponding fasteners located on the interior of the insert pocket 140. The removable insert 106 allows for the athletic garment 100 to be worn comfortably in a variety of weather conditions. For example, the insert 106 can be utilized for outdoor sports or athletic activities requiring exposure to weather conditions (e.g., running, jogging, hiking, skiing, biking, etc.).

While an insert pocket 140 is illustrated in FIGS. 4A and 4B, it is contemplated that the inner liner 104 can be configured to receive the insert 106 in other ways. For example, the insert 106 can be removably attached directly to an interior surface of the inner liner 104.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. An athletic short comprising:

an outer layer forming an article of wearing apparel, the outer layer including one or more garment forming portions coupled to a waistband, the one or more garment forming portions configured to form two leg openings configured to receive the legs of a user;

an inner liner coupled to the waistband, the inner liner including a front panel and a rear panel, the front panel and the rear panel joined to form two leg openings configured to receive the legs of the user, the inner liner including an elongated pocket disposed on an interior surface of the front panel, the elongated pocket being positioned in the center of the front panel and disposed over a groin region of the user when worn, the elongated pocket configured to receive an insert through an opening disposed therein; and a weather-resistant insert configured to removably couple to the pocket, the weather-resistant insert being comprised of a pliable textile material, the insert being generally conformable to movement of the user, the insert forming a barrier to protect the groin region of the user from a weather condition.

2. The athletic short as recited in claim 1, wherein at least one of the outer layer or the inner layer include one or more additional pockets.

3. The athletic short as recited in claim 1, wherein the weather-resistant insert is comprised of at least one of polytetrafluoroethylene, fleece, cotton, polyester, wool, fabric laminate, or a multi-layer lining material formed from a combination thereof.

4. The athletic short as recited in claim 1, wherein the weather resistant insert comprises an outer layer and an inner layer, the outer layer configured to diffuse moisture from a surface of the outer layer to the inner layer.

5. The athletic short as recited in claim 1, wherein the weather-resistant insert comprises a generally oblong shape.

6. The athletic short as recited in claim 1, wherein the inner liner is composed of mesh.

7. The athletic short as recited in claim 1, wherein the pliable textile material has a 1/Young's Modulus of at least $9\times10^{-2}$ 1/MPa.

8. The athletic short as recited in claim 1, wherein the weather-resistant insert comprises an outer layer configured to enhance at least one of comfort or breathability.

9. An athletic garment comprising:

an outer layer forming an article of wearing apparel, the outer layer including one or more garment forming portions, the one or more garment forming portions configured to receive the legs of a user;

an inner liner coupled to the outer layer, the inner liner including a front panel and a rear panel, the front panel and the rear panel joined to form two leg openings configured to receive the legs of the user, the inner liner configured to receive an insert; and an insert configured to removably couple to the inner liner, the insert being comprised of a pliable material, the insert being generally conformable to movement of the user, the insert being disposed over a groin region of the user when worn and forming a barrier to protect the groin region of the user from a weather condition.

10. The athletic garment as recited in claim 9, wherein the inner liner includes a pocket configured to receive the insert.

11. The athletic garment as recited in claim 10, wherein the pocket comprises an elongated pocket.

12. The athletic garment as recited in claim 11, wherein the pocket is disposed on an interior surface of the front panel of the inner liner.

13. The athletic garment as recited in claim 10, wherein at least one of the outer layer or the inner layer include one or more additional pockets.

14. The athletic garment as recited in claim 10, wherein the insert is comprised of a weather-resistant material.

15. The athletic garment as recited in claim 10, wherein the insert comprises a generally oblong shape.

16. The athletic garment as recited in claim 10, wherein the pliable material has a 1/Young's Modulus of at least $9\times10^{-2}$ 1/MPa.

17. The athletic garment as recited in claim 10, wherein the pliable material is comprised of a weather-resistant textile material.

18. The athletic garment as recited in claim 10, wherein the insert comprises an outer layer configured to enhance at least one of comfort or breathability.

19. The athletic short as recited in claim 10, wherein the insert comprises an outer layer and an inner layer, the outer layer configured to diffuse moisture from a surface of the outer layer to the inner layer.

20. An athletic garment comprising:

an outer layer forming an article of wearing apparel, the outer layer including one or more garment forming portions, the one or more garment forming portions configured to receive the legs of a user;

an inner liner coupled to the outer layer, the inner liner including a front panel and a rear panel, the front panel and the rear panel joined to form two leg openings configured to receive the legs of the user, the inner liner configured to receive an insert; and an insert configured to removably couple to the inner liner, the insert being comprised of a pliable material with a 1/Young's Modulus of at least $9\times10^{-2}$ 1/MPa, the insert being disposed over a groin region of the user when worn and forming a barrier to protect the groin region of the user from a weather condition.

* * * * *